United States Patent [19]

Pope

[11] Patent Number: 4,694,620

[45] Date of Patent: Sep. 22, 1987

[54] ROTATABLE BUILDING

[76] Inventor: Ralph E. Pope, 3680 Ryan Bluff Dr., Cumming, Ga. 30130

[21] Appl. No.: 924,269

[22] Filed: Oct. 29, 1986

[51] Int. Cl.[4] ..... E04B 1/346

[52] U.S. Cl. ..... 52/65

[58] Field of Search ..... 52/64, 65; 104/43, 44, 104/35; 105/28; 108/103

[56] References Cited

U.S. PATENT DOCUMENTS

| | | | |
|---|---|---|---|
| 306,197 | 10/1884 | Warner et al. | 52/65 |
| 703,705 | 1/1902 | Lockwood | 52/64 |
| 922,643 | 5/1909 | Verplanck | 104/44 |
| 2,245,318 | 6/1941 | Blank | 52/64 |
| 3,338,176 | 8/1967 | Petersen | 104/35 |

FOREIGN PATENT DOCUMENTS

| | | | |
|---|---|---|---|
| 529742 | 7/1954 | Belgium | 52/65 |
| 592577 | 2/1960 | Canada | 52/65 |
| 1223237 | 2/1960 | France | 52/65 |
| 827991 | 2/1960 | United Kingdom | 104/44 |

*Primary Examiner*—James L. Ridgill, Jr.

*Attorney, Agent, or Firm*—Scrivener and Clarke

[57] ABSTRACT

A rotatable circular building has at and adjacent the lower edge of its annular wall an inwardly extending annular horizontal flange providing a track which rests on an annular series of ground supported horizontal rollers on which the building rotates, an annular series of vertical rollers also being provided to prevent binding of the relatively movable parts when the building is moved laterally.

3 Claims, 4 Drawing Figures

ROTATABLE BUILDING

SUMMARY OF THE INVENTION

A circular rotatable building is positioned above a fixed base and supported at the lower edge of its annular wall by an annular series of horizontal ground-supported rollers which support horizontal parts of the wall, thus forming a rolling support for the building and preventing it from tipping or overturning. Vertically positioned rollers are provided to prevent binding of the relatively movable parts on any horizontal or tipping movement of the building.

DESCRIPTION OF THE INVENTION

Figure 1:
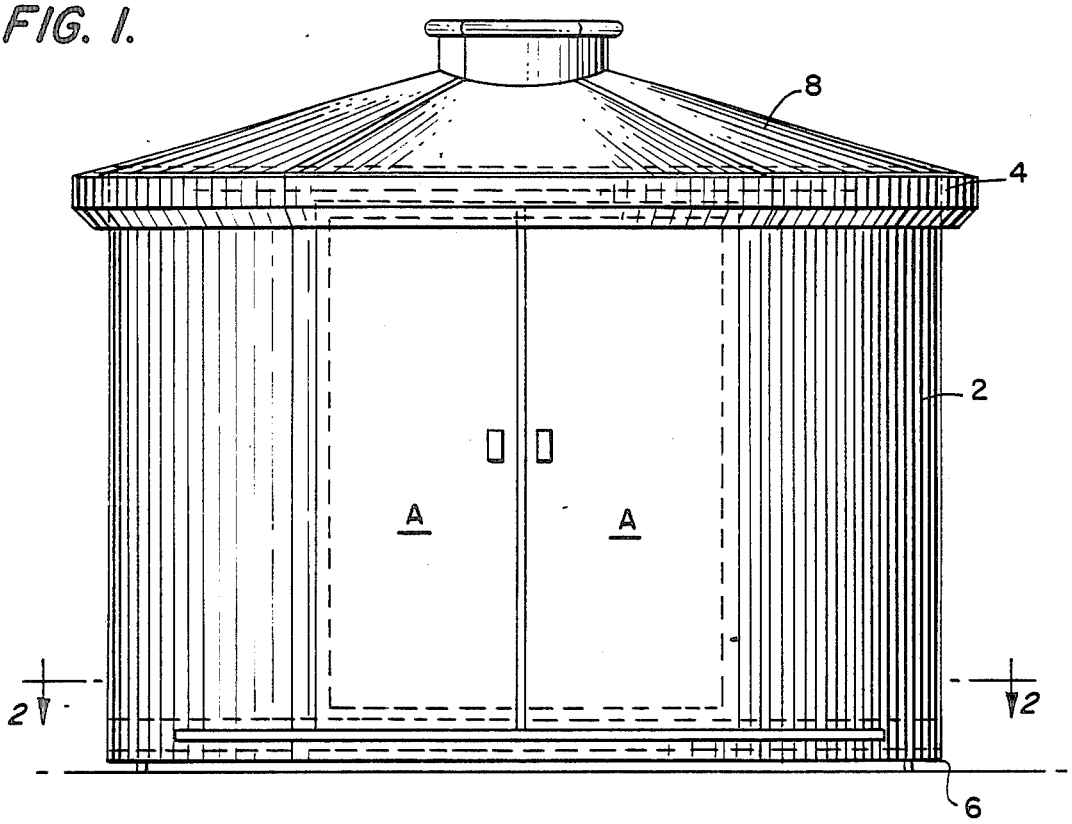
FIG. 1 is a side elevational view of a circular rotatable building including the supporting means provided by the invention.
Figure 2:
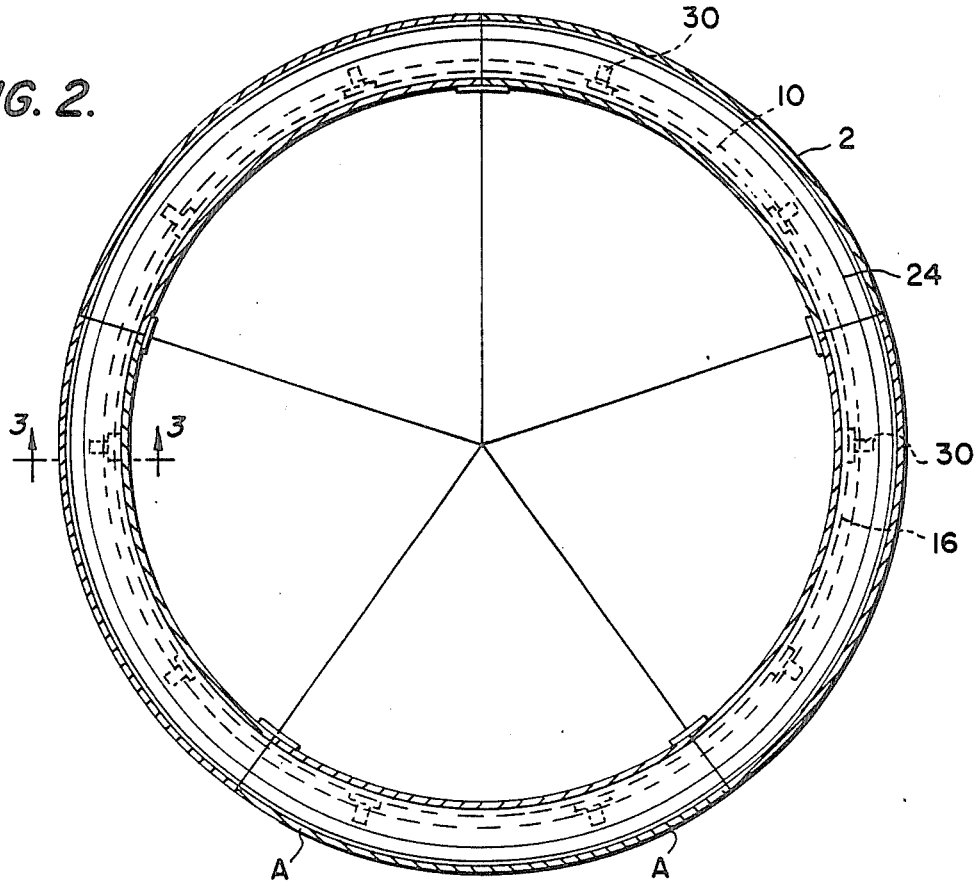
FIG. 2 is a horizontal sectional view through the building taken on line 2—2 of FIG. 1.
Figure 3:
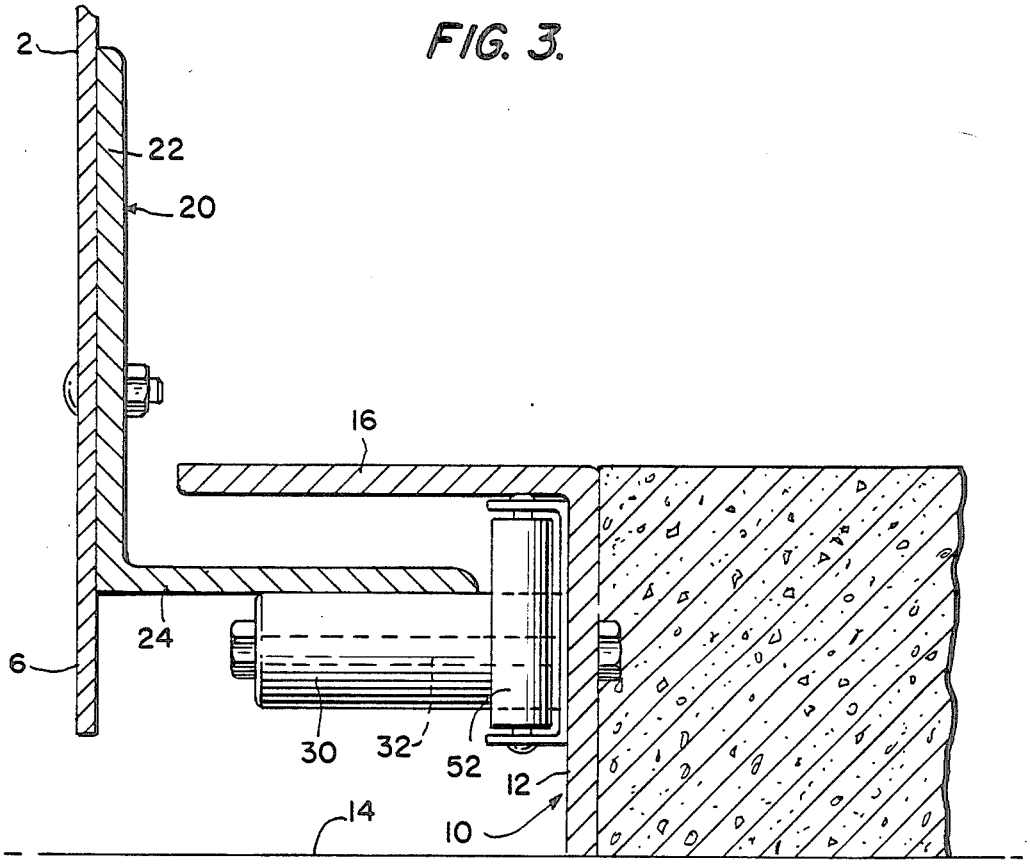
FIG. 3 is an enlarged side elevational view of any one of the supporting and stabilizing means provided by the invention.

The preferred embodiment of the circular rotatable building provided by the invention is illustrated in the drawings and comprises an annular wall 2 having upper edge part 4, lower edge part 6 and roof 8 which is preferably conical or fusto-conical in shape. Doors A are provided and may be of any suitable construction and operation, such as hinged or slidable, which will be suitable to close a door opening in the annular wall.

Means are provided by the invention for supporting the building for rotation and for preventing it from being overturned, tipped or moved laterally, and such means comprise an annular track member 10 which is of right angular cross sectional shape and is so positioned that one of its flanges 12 is vertical with its edge resting on the ground surface 14 and the other flange 16 is horizontal and above the ground surface, with its outer edge within and spaced inwardly from the inner surface of the lower part of the annular building wall 2. A second annular track member 20 of right-angular cross sectional shape has a vertical flange 22 which is connected to the inner surface of the annular building wall 2 adjacent its lower edge part 6, and also has a horizontal flange 24 which extends radially inwardly of the wall 2 and is below and spaced vertically from the horizontal flange 16 of track member 10. An annular series of a plurality of rollers 30 is mounted on the vertical flange 12 of track member 10 and extend radially outwardly from the flange, being rotatably supported on horizontal axles 32 carried by the flange 24. The cylindrical surfaces of these rollers engage the lower surface of the horizontal flange 24 which extends radially inwardly from the lower edge part of building wall 2, thus forming an annular rolling support for the building.

Figure 4:
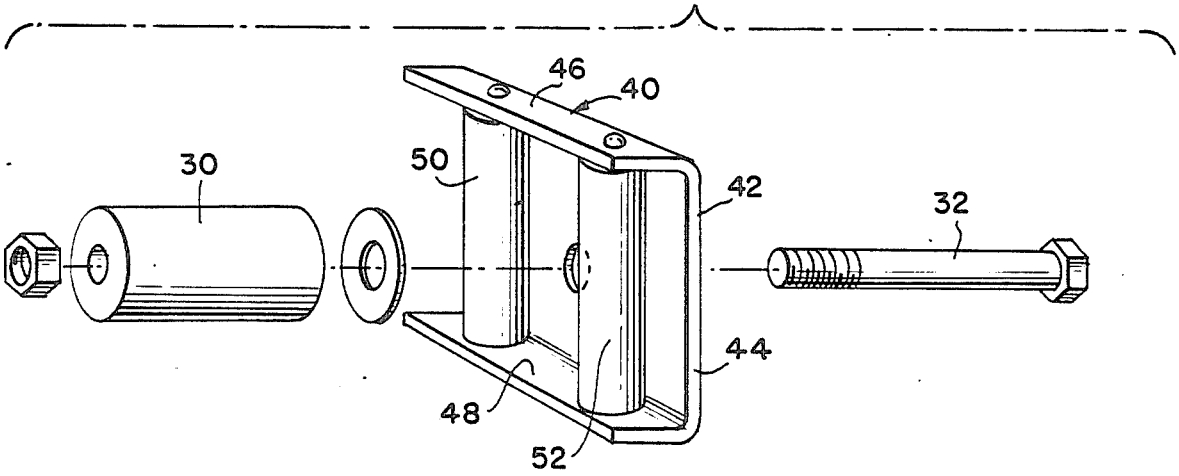
FIG. 4 is a perspective exploded view of parts shown in FIG. 3.

In the use and operation of the building it is found that the building will shift sideways under the pressure of high winds or the manual pressure produced in rotating the building or moving the doors, causing binding and friction between the free end of fixed horizontal flange 24 and the inner surface of the vertical flange 12, and means are provided by the invention for preventing this effect. Such means comprise a plurality of assembies 40 of vertical rollers, one of which is particularly illustrated in FIG. 4. Each assembly comprises a U-shaped bracket 42 having a vertical bottom wall 44 and spaced upper and lower flanges 46, 48 which support the upper and lower ends of vertical axes on which rollers 50, 52 are rotatably mounted. Each bracket is mounted on the outer surface of vertical flange 12 of track member 10 by the bolt 32 which supports a horizontal roller 30, and the vertical rollers are spaced apart a sufficient distance to permit the horizontal roller 30 to be positioned between them, but not in engagement with them, thereby to permit free rotation of all rollers.

It will be apparent that on sufficient sidewise movement of the building the free inner edge of rotatable horizontal flange 24 will engage the vertical rollers, thus preventing binding and permitting continued rotation of the building. It will be noted that even if the horizontal flanges 16, 24 are the same length the free end of rotatable flange 24 will contact rollers 50, 52 before there can be any binding engagement between the rotatable parts of the building and the fixed ground supported parts.

I claim:

1. A rotatable building comprising an annular vertical wall positioned above a fixed generally horizontal ground surface, and means for supporting the building for rotary movement and for prevention of binding when relative horizontal movement of the building and the ground surface occurs, comprising:

(a) a fixed annular member of right-angular cross sectional shape positioned within the lower part of the building wall and having a vertical flange with its free edge supported on the ground surface and a horizontal flange spaced above the ground surface and extending radially outwardly from the vertical flange with its free edge positioned inwardly of the inner surface of the building wall, (b) a plurality of horizontal cylindrical rollers supported in an annular series and connected to the vertical flange of the annular member and extending radially outwardly therefrom toward and spaced from the inner surface of the building wall, and (c) an annular flat horizontal member extending radially inwardly from the building wall with its lower surface resting on and supported by the cylindrical surfaces of the rollers, with its inner edge spaced outwardly of the vertical flange of the fixed annular member.

2. A rotatable building according to claim 1, comprising in addition:

(a) a plurality of vertical cylindrical rollers supported in an annular series and connected to the vertical flange of the annular member opposite the annular horizontal member which extends inwardly from the building wall, the free edge of said member being positioned outwardly of the cylindrical surfaces of the vertical rollers.

3. A rotatable building according to claim 2, in which the vertical rollers are arranged in spaced pairs, and those of each pair are positioned on opposite sides of one of the horizontal rollers.

* * * * *